United States Patent [19]

Gottlieb

[11] 4,130,741

[45] Dec. 19, 1978

[54] HEARING AID RELINER AND APPARATUS FOR RELINING HEARING AID EAR MOLDS

[76] Inventor: Benjamin Gottlieb, 3760 Royal Palm Ave., Miami Beach, Fla. 33140

[21] Appl. No.: 871,090

[22] Filed: Jan. 19, 1978

[51] Int. Cl.[2] ..... H04R 1/10; H04R 25/00

[52] U.S. Cl. ..... 179/107 E; 179/182 R; 181/135

[58] Field of Search ..... 179/107 E, 107 H, 107 S, 179/182 R; 181/130, 135, 132; 128/2 Z

[56] References Cited

U.S. PATENT DOCUMENTS 3,979,567 2/1975 Frye ..... 179/107 E

*Primary Examiner*—George G. Stellar

[57] ABSTRACT

For the ear mold which fits in the ear canal of the ear of a wearer of a hearing aid, a reliner to hermetically seal between the surface of the ear mold and the tissues of a wearer to eliminate feedback and wherein the coating is applied and is selected from the class of adhesives which are non-toxic.

6 Claims, 1 Drawing Figure

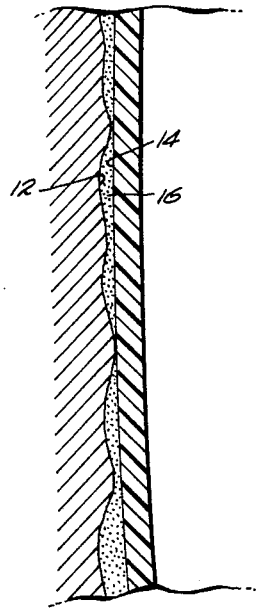
14
12
16

HEARING AID RELINER AND APPARATUS FOR RELINING HEARING AID EAR MOLDS

FIELD OF THE INVENTION

This invention relates to hearing aids and, more particularly, to a reliner means for coating the exterior surface of the ear mold, that is the piece that fits into the ear canal of a person's ear.

BACKGROUND OF THE INVENTION

There are numerous types of hearing problems. In the past, the solution has been to use hearing aids composed of an ear mold, that is, a piece which fits in the ear canal, a hearing aid including an amplifier speaker power supply battery regulator means to control the power and a clip for attachment to the ear and a means to connect the hearing aid to the ear mold. Generally speaking, the ear mold, that part which fits in the ear canal, is made by taking an impression of the ear in accordance with methods which are well known in the prior art, and some of which are the subject of patents in the art. The ear of a human can be considered as being composed of an outer ear, a middle ear, which has a hammer and anvil, and an inner ear. Hearing aids have been effective in solving many problems of people who have a defect in the middle ear zone. On the other hand, hearing aids have not proved to be as effective for those people having problems with the inner ear, that is, where the auditory nerves are destroyed, which some consider to be hair-like cells which are very sensitive. Person's with inner ear problems have a need for substantial power, relatively speaking, and when the power is increased, a feedback or whistling often occurs. Needless to say, this interfers with the ability of a person to hear utilizing his hearing aid.

A careful investigation demonstrates that ill-fitted ear molds are an important cause of feedback or whistling which is so objectionable. In the past, efforts have been made to position an ear mold snugly into the ear canal of a person's ear, see for example, U.S. Pat. No. 3,865,998; however, it will be readily appreciated that if the ear mold is slightly oversized and pressed into a person's ear it is to say the least quite uncomfortable. On the other hand, if it is loosened up by making it somewhat undersized, the problem of feedback is ever present when power is needed and, also, the ear mold fits loosely causing disturbing rattling noises and a general insecure feeling.

Faced with the problem of a high degree of discomfort or loose ear molds many people with inner ear problems involving destruction of the auditory nerves to a substantial degree, have been required to turn to lip reading courses and other efforts. This is because if the power is not turned up on their hearing aid, there is less amplification and words are missed and important tones and sounds involving the hearing ability are lost. When the power is increased, there is then the interfering whistling or feedback noises.

THE PRESENT INVENTION GENERALLY

The present invention generally is to provide a ear mold of a hearing aid in combination with a coating of non-toxic adhesive material to reline the exterior of the ear mold so that many people who cannot afford several hundred dollars for new hearing aids with ear molds as their body changes slightly or who cannot tolerate the relatively high degree of discomfort which comes from a snug or tight fitting ear mold, may simply reline their hearing aid ear mold daily to effect a seal between the tissues of the ear canal and the surface of the ear mold.

OBJECTS OF THE INVENTION

It is, accordingly, an object of this invention to provide a process for relining the ear mold of hearing aids to provide a limited range of adjustment within a small but critical range about an ear mold to provide a seal against feedback and whistling noises when relatively high power is utilized such as by persons having problems with their inner ear.

In accordance with this general object, the instant invention will now be described with reference to the accompanying drawing. The drawing illustrates schematically the exterior surface 12 of the tissues of the ear canal, the exterior surface 14 of an ear mold, and a very slight or thin coating of non-toxic adhesive material 16 between the surface of the ear mold and the surface of the ear canal tissues.

DESCRIPTION OF THE PREFERRED EMBODIMENT OF THE INVENTION

Referring to the drawing, the surface 14 of an ear mold is coated for example using a Q-tip with a non-toxic adhesive 16 then the coated ear mold is inserted into the ear where the slight pattern in relief, that is the crests and troughs typical of tissues 12 of skin in the ear canal, are in close adjacent relation to the surface of the ear mold and wherein the non-toxic adhesive provides a critical thin range of adjustment to compensate for the minor variations in the surface pattern in relief of the tissues and tend to block air carried sound waves from passing around the ear mold to the outside of the ear where the pick-up of the hearing aid amplifies the sound again and again causing feedback and whistling.

Generally speaking, in a preferred embodiment the instant invention comprises improving the ear mold by applying a non-toxic solution that has adhesive properties to the exterior surface of the ear mold. The adhesive is applied with a Q-tip to part of the ear mold that is inserted into the ear. It is evenly covered and the mold is inserted into the ear and held in position for a period of about one-half minute to a minute or two. The ear mold is firmly but temporarily secured in this manner and hermetically sealed for practical purposes in the external ear canal with the surface of the ear mold closely adjacent the tissues of the ear canal and with the non-toxic adhesive taking up the remaining spaces to stop feedback noises. An application in the morning is sufficient for the use during a regular day length period. The utilization of the coating reduces and substantially eliminates the feedback noises allowing one to adjust the amplification higher in order to pick up all important sounds and without the problem of interference caused by the feedbacks. Persons with inner ear problems utilizing the reliner means described have enhanced the ability to hear in normal conversations, because of improved hearing and tone reception.

In general, the present invention comprises the application of a non-toxic adhesive coating to the exterior surface of an ear mold to be placed into the ear canal of a wearer wherein the thickness of the non-toxic adhesive provides for a new range of adjustment within a small but critical range to compensate for and to fill the spaces between the ear canal and the surface of an ear mold when one has been inserted. The non-toxic adhesive described hereinafter may be applied with a Q-tip or match to which a cotton swab has been applied. After the coating has been applied to an ear mold, it is allowed to dry for a short period of time, up to about 2 or 3 minutes, and then it is inserted into the ear where it is held in position for a suitable length of time which may be up to five minutes or so but which usually is sensed by the user as being sufficient in about one to two minutes with use.

This expands the range of power which may be used without the whistle-type feedback interference. After use, that is, at the end of the day, the ear mold may be readily removed and with a little cold cream the adhesive may be removed from the surface of the ear mold to be relined the next day utilizing the non-toxic adhesive.

It will be understood that the problem of making ear molds is quite difficult and although acurate ear molds are made which generally conform to a person's ear canal, precision is difficult if not impossible. There are many factors involved. Sometimes the material of the ear mold shrinks slightly, sometimes it is not perfectly acurate in shape, and, at other times, the person's body changes slightly and, in any event, there are very small passageways or pores through which sound waves can travel causing the feedback. The present relining technique closes this pathway between the ear mold surface and the ear canal and blocks this feedback without providing an uncomfortable tight fitting ear mold or one which is loose and permits feedback. It is not the applicant's invention to provide a process for making ear molds but, rather, correcting or relining ear molds e.g., to vary the surface slightly within a critical range of adjustment through use of a non-toxic adhesive coating.

An example of a suitable non-toxic adhesive is the use of an adhesive which is known in the trade as No. 458. It is a polyvinyl acetate copolymer water based synthetic resin with tackifiers added of the benzoate type. All of the ingredients referred to in the preceding sentence are listed in the Federal Register as being safe and non-toxic as a food packaging adhesive. The ingredients contain no organic solvents or ingredients other than water as a carrier. The same remain clear and do not yellow with age.

Another example of a suitable non-toxic adhesive to be applied as a coating to an ear mold is a natural latex emulsion containing rosin type tackifiers. A suitable preservative may be added to prevent putrefaction. On aging the emulsion may change color to a yellow or deeper yellow approaching orange. A suitable coating is of adhesive No. 31 as it is denominated in the trade. In any event, the adhesives when applied to a surface will dry permanently tacky and should remain tacky for approximately one hour. The film which is produced is dry and water insoluble, that is water resistant when dry. However, it may be washed from a surface when it is still wet by the use of plain water and can be readily cleaned from a surface to which it has been applied after it has dried by using cold cream.

It is thus seen that there has been described a coating and examples for a coating to be used as a relining means for an ear mold to reduce feedbacks and the described invention is for use in improving existing ear molds to seal them relative to an ear canal for which they are fitted to act as a reliner and to reduce and substantially eliminate feedback noises causing whistling and thereby increasing the tone and the range of hearing of persons having problems, especially those having problems with the inner ear.

In a preferred example the coating may be of any selected constituency either a liquid or a paste. In the event that it is a paste, it may be spread somewhat more easily over the surface of the ear mold; however, it may readily be painted when in a liquid form. The criteria is that in use the application in a band about the ear mold will effect a hermetic seal generally and conform to the surface of the ear mold and the surface of the tissues of the ear about the ear mold so as to provide a critical range of adjustment in a very small range about the periphery of the ear mold to effectively block substantially eliminating feedback and transmittal of sound waves causing whistling.

This application contains the disclosure referred to in the Disclosure Document of the applicant filed in the U.S. Patent and Trademark Office and dated Sept. 7, 1977.

What is claimed is:

1. The process of relining an ear mold sized to fit the ear canal of a particular wearer which comprises the steps of applying a coating to the exterior surface of the ear mold wherein said coating comprises an adhesive of flowable material and inserting the coated ear mold into the ear canal wherein the coating comprises means for effecting a seal between the surface of the ear mold and the tissues within the ear canal to reduce feedback.

2. The process as set forth in claim 1 wherein the coating is air dried for a period of between ½ minute and 5 minutes prior to inserting into the ear canal.

3. The process as set forth in claim 2 wherein the coated ear mold is held in position in the ear for a period of ½ second to 5 minutes to effect a hermetic seal upon drying and wherein the coating dries to a tacky surface.

4. A non-toxic adhesive coating and ear mold piece of a hearing aid in combination wherein the coating is applied exteriorly to the surface of the ear mold and said coating comprises polyvinyl acetate copolymer water based synthetic resin and tackifiers of the benzoate type.

5. A non-toxic adhesive coating and ear mold piece of a hearing aid in combination wherein the coating is applied exteriorly to the surface of the ear mold, and said non-toxic adhesive comprises a natural latex emulsion containing rosin-type tackifiers.

6. The device as set forth in claim 5 wherein the coating includes a preservative added to prevent putrefaction.

* * * * *